United States Patent [19]

Treadway

[11] 3,989,079

[45] Nov. 2, 1976

[54] CUE DRESSER

[76] Inventor: Bill A. Treadway, 1995 E. Ross Road, Tipp City, Ohio 45371

[22] Filed: Dec. 17, 1975

[21] Appl. No.: 641,648

[52] U.S. Cl. ..... 145/27
[51] Int. Cl.[2] ..... B27L 9/00
[58] Field of Search ..... 145/27

[56] References Cited

UNITED STATES PATENTS

| | | | |
|---|---|---|---|
| 284,548 | 9/1883 | Gwyn | 145/27 |
| 334,648 | 1/1886 | Dougherty | 145/27 |
| 942,876 | 12/1909 | Ansell | 145/27 |
| 955,819 | 4/1910 | Mahoney | 145/27 |
| 1,259,136 | 3/1918 | Rogers | 145/27 |
| 1,532,060 | 3/1925 | Mortimer | 145/27 |
| 1,534,975 | 4/1925 | Lindfors | 145/27 |
| 2,577,995 | 12/1951 | Bozarth | 145/27 |

FOREIGN PATENTS OR APPLICATIONS

| | | | |
|---|---|---|---|
| 23,534 | 7/1921 | France | 145/27 |

*Primary Examiner*—James L. Jones, Jr.
*Assistant Examiner*—J. T. Zatarga
*Attorney, Agent, or Firm*—Biebel, French & Nauman

[57] ABSTRACT

A light weight, pocket size cue dresser for shaping a cue tip to the various shapes and styles desired by individual pool players. A single, specially designed dressing surface allows the cue tip to be shaped to a variety of configurations, eliminating the necessity for a plurality of differently sized and shaped dressing surfaces and thereby providing a dresser which may be carried in the pocket or on a key chain, permitting the player to dress the cue tip as necessary during the course of a game to maintain it in the particular configuration desired.

10 Claims, 6 Drawing Figures

CUE DRESSER

BACKGROUND OF THE INVENTION

The particular shape of a cue tip desired by a pool player can vary considerably from, for example, a relatively gently sloped surface to a more conical shape. Additionally, the shape of a cue tip becomes more critical with more experienced pool players and an experienced pool player will dress his cue tip frequently to insure that it is maintained in the shape that he desires.

In this regard he might use a piece of sandpaper or a knife, although various other types of cue dressers are known. See, for example, U.S. Pat. Nos. 259,136; 284,548; 1,534,975 and 2,577,995.

The difficulty with dressers of the general type shown in these patents is that they are usually adapted to impart only a single configuration to a cue tip, so that specially shaped dressing surfaces or elements must be manufactured for each cue tip style desired or only an approximation of the desired shape can be attained.

The above noted U.S. Pat. No. 284,548 attempts to obviate this problem by providing a number of recesses, six to twelve are shown, each having a different shape. The difficulty with this latter type of dresser is that it must necessarily be larger than desirable for individual use, particularly for use by a player during the course of a game.

SUMMARY OF THE INVENTION

In accordance with the present invention a cue tip dresser is provided which, because of its specially configured surface can be used to dress a cue tip to a wide variety of styles and yet, since it uses only a single cavity, can be made extremely compact and light weight, to the extent that it can be carried readily in a player's pocket or on a key chain or the like.

Specifically, the dresser of the present invention in overall dimensions need be only enough to accommodate the single cavity required in the dresser of the present invention. Typically the dresser, if it is of cube shape, need be no more than three-fourths of an inch square and less than that in depth. Additionally, the body portion of the dresser can be formed of a light weight material such as aluminum.

The specially configured dressing surface is generally parabolic in shape but is defined as a segment of a circle revolved about the axis of the generally parabolic cavity with the center of curvature of the circle segment offset to a side of the axis opposite the side on which the circle segment is disposed.

With this configuration various shapes can be dressed on a cue tip, depending upon the angle at which the tip of the cue stick is inserted into the cavity. For example, if the tip of the cue stick is inserted substantially in line with the axis of the cavity a somewhat conical tip is obtained, whereas if the tip of the cue stick engages only that portion of the cavity to one side of its axis a much flatter tip will result.

Of course, variations between these two types of configurations are obtained by varying the angularity between the two positions described above and in practice it has been found that one using the dresser of the present invention can readily shape his cue tip to his own specifications.

For best results it has been determined that the radius of curvature of the circle segment defining the surface of the dressing cavity should be from fourteen to sixteen thirty-seconds of an inch and a preferred offset of the center of curvature with respect to the axis of the cavity is approximately three thirty-seconds of an inch.

With these dimensions the total height of a three-quarters of an inch square, cube shaped dresser need be no more than seven-sixteenths of an inch, with an abrasive covering the surface of the dresser beginning approximately one-sixteenth of an inch below the upper face of the body portion of the dresser and the bottom of the cavity being approximately one-sixteenth of an inch above the bottom face of the dresser. For an abrading material a fifty grit emery cloth cemented in place by an epoxy adhesive has been found suitable.

While a cube shaped dresser having substantially square upper and lower faces is referred to above, it will be apparent that the outside shape of the dresser body portion can be varied as desired, including circular and polygonal shapes.

From the above and the following description it will be seen that an extremely compact cue tip dresser is provided by the present invention through the provision of a dressing surface of a particular configuration which allows a cue tip to be dressed to any of a plurality of different configurations using only a single dressing cavity.

DESCRIPTION OF THE PREFERRED EMBODIMENTS

Figure 1:
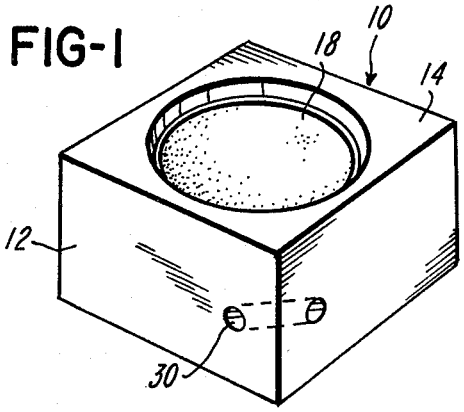
FIG. 1 is a perspective view of a cue tip dresser in accordance with the present invention.
Figure 2:
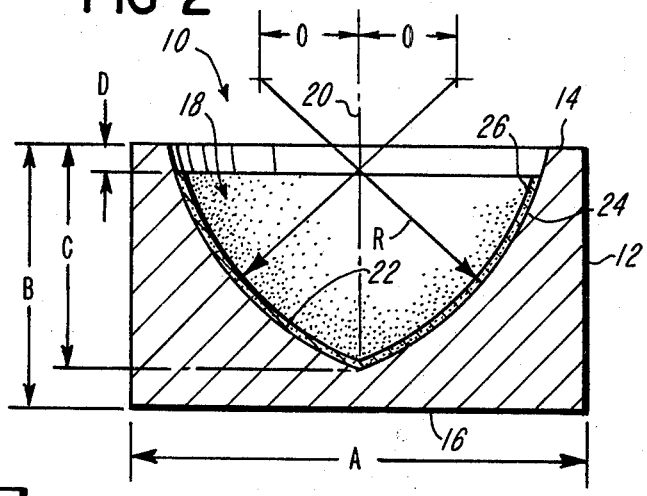
FIG. 2 is a cross-sectional view thereof.
Figure 3:
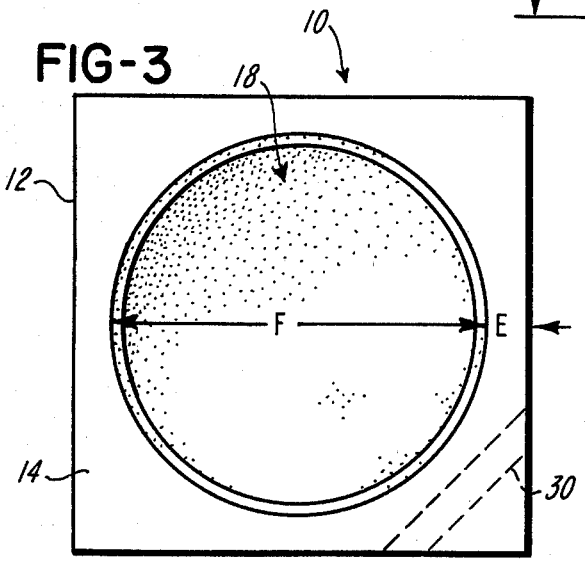
FIG. 3 is a top view of the dresser of FIGS. 1 and 2.

With reference initially to FIGS. 1 through 3 of the drawings, it will be seen that a cue dresser 10 in accordance with the present invention consists of a main body portion 12 having upper and lower faces 14 and 16, respectively. Formed in the upper face 14 and extending into the body portion 10 is a cavity 18 of, as best seen in FIG. 2, generally parabolic configuration, having its axis 20 extending generally perpendicular to the upper and lower faces 14 and 16.

While the cavity 18 is of generally parabolic shape, for best results the surface 22 thereof should be defined by a segment 24 of a circle revolved about the axis 20 with the center of curvature of the circle segment offset from the axis 20 and lying on the opposite side thereof from the circle segment.

The surface 22 is then covered with an abrasive 26, satisfactory results having been obtained with a fifty grit emery cloth secured in place by means of an epoxy adhesive or the like.

With this configuration it will be seen that a variety of cue tip shapes can be formed using the single cavity of the dresser of the present invention.

Figure 6:
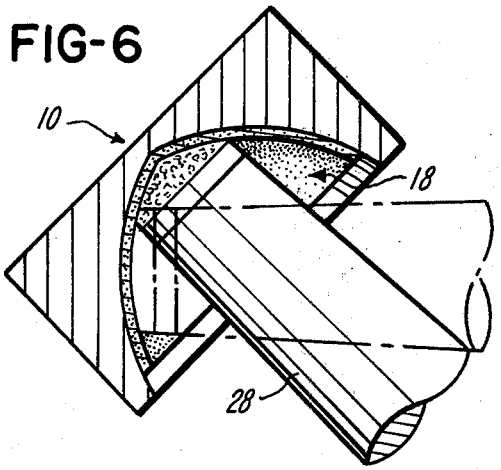
FIG. 6 is a somewhat schematic view illustrating the manner of using the cue dresser of the present invention.

Thus, as shown in FIG. 6 of the drawings, if a somewhat conical shape is desired, which is the preferance of many experienced pool players, the cue tip is inserted into the dresser with the axis of the cue stick 28 substantially aligned with the axis of the cavity 18. The dresser and/or the cue stick is then, of course, rotated to dress the cue tip to the desired shape.

If a somewhat flatter configuration is desired then the cue tip is inserted into the concavity 18 with the cue stick 28 angularly disposed with respect to the axis of the concavity 18. Obviously between these two positions an infinite number of variations are possible resulting in an infinite number of cue tip shape variations.

Since the body portion of the dresser need only be large enough to accommodate a single cavity of the specific shape herein disclosed the dresser may be very compact, suitable for being attached to a key chain or the like by means of an opening 30 or merely carried in the pocket if desired.

As an example, the dresser shown in FIGS. 1 through 3 may be cube shaped, having square upper and lower faces with the dimension A approximately three-fourths of an inch, the dimension B approximately seven-sixteenths of an inch, the dimension C approximately three-eighths of an inch, and the dimension D approximately one-sixteenth of an inch. Additionally, the dimension E (FIG. 3) may be kept as small as necessary for machining purposes, on the order of one-sixteenth of an inch.

For best results, the radius R of the circle segment 24 should be in the range of fourteen to sixteen thirty-seconds of an inch and the offset 0 approximately three thirty-seconds of an inch. A maximum diameter F of five-eights of an inch has been found sufficient although this may increase up to approximately three-fourths of an inch if desired. The dimension of the key chain opening 30 may conveniently be one-eighth of an inch in diameter.

Figure 4:
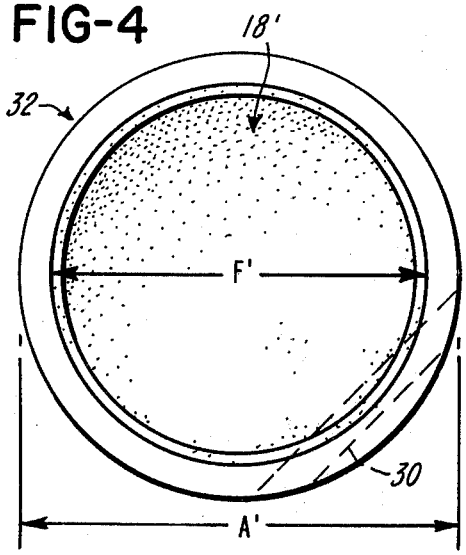
FIGS. 4 and 5 are views similar to FIG. 3 but showing additional embodiments of the present invention.
Figure 5:
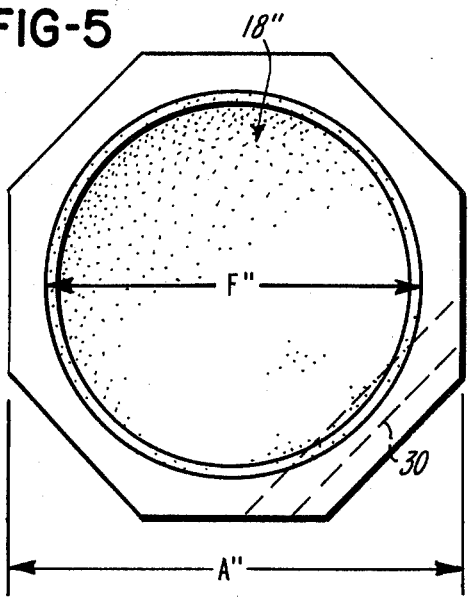

In the embodiment of FIGS. 1 through 3, the body of the dresser is in the shape of a cube. Obviously a number of other shapes are within the scope of the present invention. Thus, as seen in FIG. 4, the dresser 32 may be of circular cross-section formed, for example, from a piece of bar stock having a diameter A′ equal to the dimension A of the embodiment of FIGS. 1 through 3. The inner diameter F′ can similarly be of the same dimension as the diameter F of the embodiments of FIGS. 1 through 3. In FIG. 5, the dresser is shown as being of octagonal cross section, having a dimension A″ equal to the dimension A and A′ of the previous embodiments and a diameter F″ equal to the diameters F and F′.

From the above it will be apparent that the cue dresser of the present invention, although compact and readily carried in a pocket or on a key chain, is capable of shaping a cue tip to a wide variety of sizes and shapes.

While the articles herein described constitute preferred embodiments of the invention, it is to be understood that the invention is not limited to these articles, and that changes may be made therein without departing from the scope of the invention.

What is claimed is:

1. A cue dresser comprising:

a. a body portion of light weight material, b. said body portion having a maximum dimension less than one and one-half inches, c. a cavity formed in one face of said body portion, d. said cavity being approximately parabolic in shape with the axis thereof extending into said body portion from said face thereof and with the shape of said cavity being defined by a segment of a circle revolved about said axis with the center of curvature of said circle segment being non-coincident with said axis and offset to the side of said axis opposite said circle segment, and e. an abrasive covering the surface of said cavity.

2. The dresser of claim 1 further comprising:

a. a relatively small diameter key chain hole formed through said body portion outwardly of said cavity.

3. The dresser of claim 1 wherein:

a. the radius of said circle segment is from fourteen to sixteen thirty-seconds of an inch.

4. The dresser of claim 1 wherein:

a. said offset of said center of curvature of said circle segment is approximately three thirty-seconds of an inch.

5. The dresser of claim 1 wherein:

a. the shape of said face of said dresser is square.

6. The dresser of claim 1 wherein:

a. said shape of said face of said dresser is hexagonal.

7. The dresser of claim 1 wherein:

a. said shape of said face of said dresser is circular.

8. The dresser of claim 1 wherein:

a. the maximum diameter of said cavity is less than three-fourths of an inch.

9. The dresser of claim 1 wherein:

a. said abrasive comprises an approximately fifty grit emery cloth.

10. A cue dressr comprising:

a. a cube shaped body portion of aluminum, b. said body portion having square upper and lower faces with the sides of the square approximately three-fourths of an inch in length, c. means defining a key chain hole of approximately one-eighth of an inch in diameter formed diagonally through a corner of said cube shaped body portion, d. a generally parabolicly shaped cavity formed in said upper face of said body portion with the axis thereof extending substantially perpendicular to said upper face, e. the surface of said cavity being defined by a segment of a circle revolved about said axis with the center of curvature of said circle segment being offset to the side of said axis opposite said circle segment, and f. a fifty grit emery cloth abrasive covering substantially all of said surface of said cavity.

* * * * *